US006557455B2

(12) United States Patent
Keyster et al.

(10) Patent No.: US 6,557,455 B2
(45) Date of Patent: May 6, 2003

(54) TWO PIECE BARREL DESIGN FOR A HYDRAULIC OIL PUMP

(75) Inventors: Eric S. Keyster, Peoria, IL (US); Timur T. Trubnikov, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/943,034

(22) Filed: Aug. 30, 2001

(65) Prior Publication Data

US 2002/0088341 A1 Jul. 11, 2002

Related U.S. Application Data

(60) Provisional application No. 60/237,317, filed on Oct. 2, 2000.

(51) Int. Cl.[7] ..... F01B 3/00

(52) U.S. Cl. ..... 92/71; 92/128; 92/169.1; 29/888.02

(58) Field of Search ..... 29/888.06, 888.061, 29/888.02, 888.025; 92/71, 128, 169.1

(56) References Cited

U.S. PATENT DOCUMENTS 2,285,476 A * 6/1942 Wahlmark ..... 92/71 X
2,423,373 A * 7/1947 Chandler ..... 92/71
3,707,034 A * 12/1972 Alger et al. ..... 92/169.1 X
3,707,035 A * 12/1972 Alger et al. ..... 92/169.1 X
3,709,108 A * 1/1973 Alger et al. ..... 92/169.1 X
3,803,687 A * 4/1974 Alger et al. ..... 29/888.061
3,808,659 A * 5/1974 Alger et al. ..... 29/888.061
5,603,609 A 2/1997 Kadlicko
6,035,828 A 3/2000 Anderson et al.

* cited by examiner

*Primary Examiner*—Edward K. Look
*Assistant Examiner*—Thomas E. Lazo
(74) *Attorney, Agent, or Firm*—Liell & McNeil

(57) ABSTRACT

The present invention finds applicability in barrel assemblies defining a ring shaped cavity that is to be fluidly sealed from a central bore. Current barrel assemblies, such as those used in hydraulic pumps, are made from castings. This can be undesirable due to long production time and difficulty in producing consistent components. The present invention is directed to overcoming one or more of these problems by disclosing a barrel assembly and a method for making the same wherein the barrel and the plug are manufactured from the same material, or from materials having similar coefficients of thermal expansion. Thus, upon pump operation and optional heat treatment of the assembled barrel assembly, both the barrel and the plug will expand in a similar manner. The present invention finds application in axial piston pumps, especially for high pressure hydraulic systems, and other two piece components having a cavity requiring a seal.

20 Claims, 3 Drawing Sheets

TWO PIECE BARREL DESIGN FOR A HYDRAULIC OIL PUMP

This application claims priority to provisional patent application Ser. No. 60/237,317, filed Oct. 2, 2000 with the title 2-Piece Barrel Design For A Hydraulic Oil Pump.

TECHNICAL FIELD

The present invention relates generally to a barrel assembly for an axial piston pump, and more particularly to a barrel having a ring shaped cavity closed to a central bore at least in part by a collar and a method of forming the same.

BACKGROUND

Currently, barrels for axial piston pumps are usually made from castings. Such a casting is illustrated in U.S. Pat. No. 6,035,828, entitled Hydraulically-Actuated System Having A Variable Delivery Fixed Displacement Pump, which issued to Anderson et al. on Mar. 14, 2000. However, this method of production, while adequate, can be undesirable for a number of reasons. For instance, this method of producing pump barrels can result in long production times and difficulty in producing accurate parts. First, forming the casting can be difficult because the core that creates a ring shaped accumulator cavity defined by the barrel can shift position during pouring of the casting. This can cause positional tolerances of the barrel to be exceeded. In addition, when the cast material is not homogenous in content, it will contain relatively hard granules that are separated by relatively soft material. As the relative hardness of the casting granules approaches the hardness of the machining tool, the machining tool can be worn excessively fast.

The present invention is directed to overcome a one or more of the problems as set forth above.

SUMMARY OF THE INVENTION

According to one aspect of the present invention, a barrel assembly for an axial piston pump includes a barrel that defines a ring shaped cavity which opens to a central bore, and a plurality of parallel piston bores that surround the central bore and open to the ring shaped cavity. A collar is attached to the barrel and closes the ring shaped cavity to the central bore.

According to another aspect of the present invention, a pump includes a housing. A barrel assembly is mounted in the housing and provides a collar that is attached to the barrel to define a ring shaped cavity which surrounds, but is closed to, a central bore. The barrel defines a plurality of parallel piston bores that open to the ring shaped cavity. A piston is slideably received in each of the piston bores. A drive plate which has a slanted drive surface is rotateably mounted in the housing and is operably coupled to each piston.

According to yet another aspect of the present invention, a method of making a barrel assembly for a pump includes forming a barrel to provide a ring shaped cavity that opens to a central bore. The ring shaped cavity is closed to the central bore at least in part by attaching a plug into the barrel.

DETAILED DESCRIPTION

Figure 1:
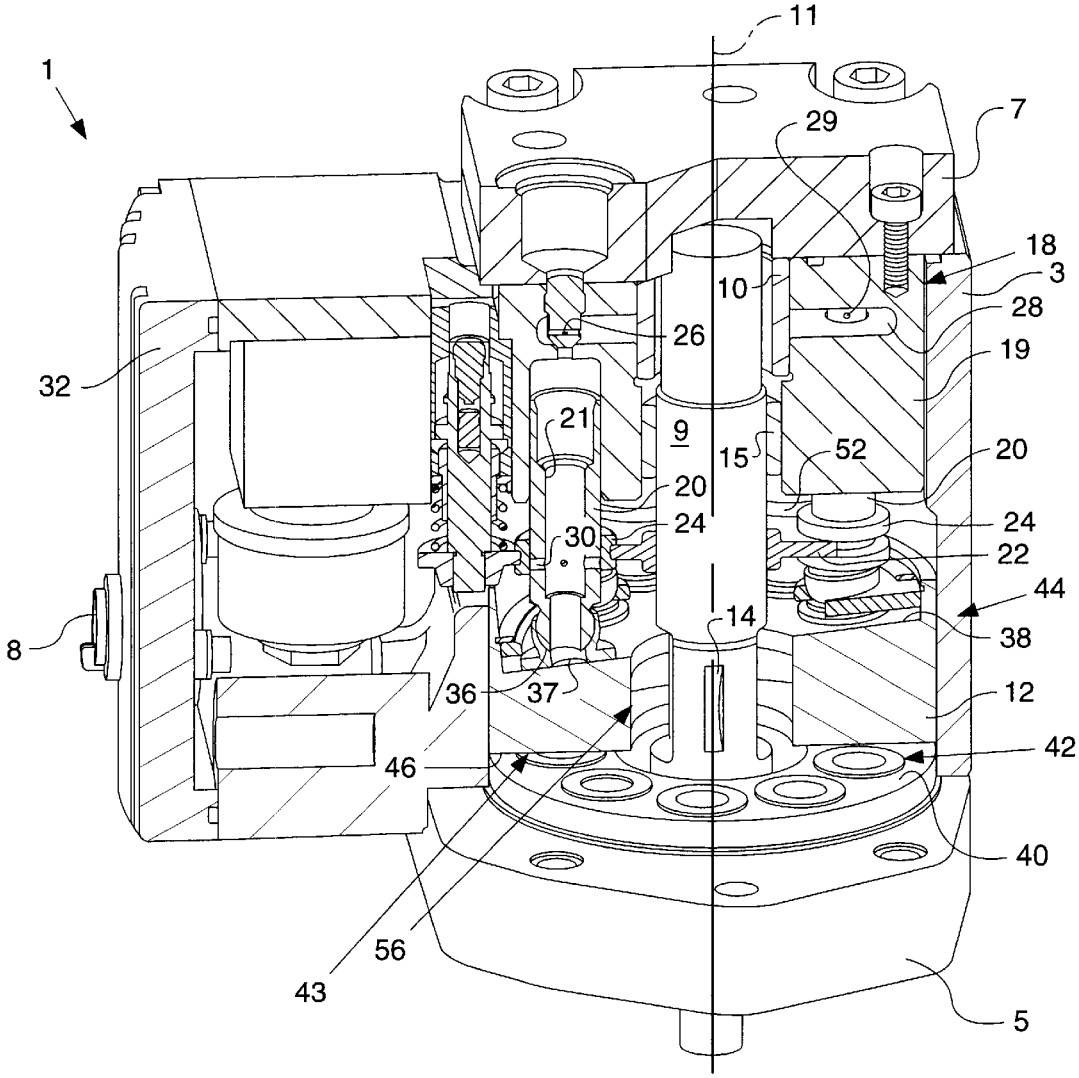
FIG. 1 is a partially sectioned isometric diagrammatic view of an axial piston pump according to the present invention.
Figure 2:
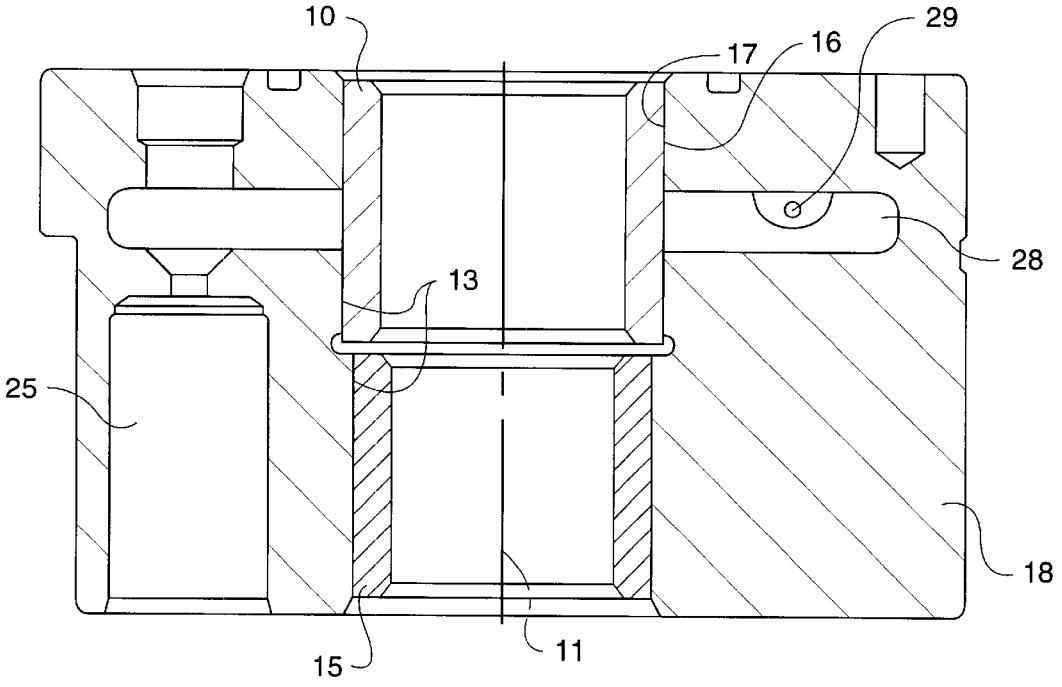
FIG. 2 is a sectioned side diagrammatic view of the barrel assembly of the pump of FIG. 1.

Referring now to FIGS. 1 and 2, there is illustrated a pump 1 according to the present invention, as well as a barrel assembly 18 for use with pump 1. Pump 1 includes a housing 3 that is positioned between a front flange 5 and an end cap 7. A drive shaft 9, driven by an engine, extends into pump 1 and is adjacent a sealing collar 10. Drive shaft 9 is radially supported by a journal or roller bearing 15 pressed into the drive shaft bore. As illustrated, drive shaft 9 is preferably connected with a wobble plate type drive plate 12 in a keyway drive configuration in which a key fits into a drive shaft slot 14 and a drive plate slot in drive plate 12. While a keyway drive configuration that allows drive plate 12 to rotate a non-rigid manner is preferred, it should be appreciated that other configurations are possible.

Referring now to barrel assembly 18, a two piece barrel 19 is provided which is bolted to end cap 7 and defines a central shaft bore 13 having a centerline 11. Barrel 19 also defines a plurality of parallel piston bores 25, which surround central shaft bore 13 and open into a ring shaped collector cavity 28. Ring shaped collector cavity 28 is preferably closed from central shaft bore 13 by sealing collar 10. Sealing collar 10 is preferably ring shaped, having a substantially uniform thickness, and has an outside diameter 16 that is greater than an inside diameter 17 of central shaft bore 13. Sealing collar 10 is preferably press fit attached to barrel 19 at high pressure after ring shaped collector cavity 28 is formed such that adequate sealing between central shaft bore 13 and ring shaped collector cavity 28 will result. Alternatively, sealing collar 10 could be fit into central shaft bore 13 by cooling sealing collar and heating barrel 19. In addition, barrel 19 and sealing collar 10 are preferably composed of identical substantially homogeneous metallic alloys, such as rod stock, or process steel, which does not tend to wear away machining tools like the prior art casting material. When identical materials are used, the thermal expansion of both barrel 19 and sealing collar 10 will be the same during the pump operation or optional heat treatment. However, it should be appreciated that these components could be machined from a material other than a substantially homogeneous metallic alloy. It should further be appreciated that barrel 19 and sealing collar 10 could be made from different materials, so long as the materials utilized have similar coefficients of thermal expansion.

Returning to pump 1, a plurality of pistons 20 are positioned in barrel 19. Each piston 20 is slideably received within a respective piston bore 25, such that it can reciprocate between an advanced and a retracted position. In addition, a number of sleeves 24 are moveably positioned around each piston 20 and are connected via connector 22. Spill ports 30 are defined by each piston 20 to be in close proximity to the respective sleeve 24. An electro-hydraulic control unit 32 can control the vertical position of each sleeve 24 about its respective piston 20, to control discharge of pump 1 by selectively allowing sleeves 24 to cover or uncover spill ports 30 during a variable portion of piston 20 compression. Fluid can enter each pumping cavity from an opening 37 via a hollow interior 21 of piston 20 and a supply opening 56. A one way outlet check nozzle 26 is positioned on a top end of each piston 20 to allow compressed hydraulic fluid to flow into ring shaped collector cavity 28 for output from pump 1 via one or more high pressure outlet passages 29.

Each piston 20 is connected to a piston shoe 34 via a flexible joint, such as a ball joint 36, such that piston shoes 34 can conform to a slanted pumping surface 38 of draft plate 12 as it rotates. In turn drive plate 12 rests against a hydrostatic thrust bearing plate 40 on front flange 5 that provides a number of thrust pads 42, each positioned directly beneath a respective one of pistons 20. Hydraulic fluid, for example engine lubricating oil, from within a low pressure interior 52 of pump 1, forms a hydrostatic thrust bearing 43 between drive plate 12 and thrust pads 42 during rotation of drive plate 12. In addition, hydraulic fluid also forms a hydrodynamic journal bearing 44 between a radial outer surface of drive plate 12 and housing 3 as drive plate 12 rotates.

INDUSTRIAL APPLICABILITY

The key way drive or other non-rigid rotation and drive arrangement allows drive shaft 9 to rotate drive plate 12 in a non-rigid manner. Rotation of drive plate 12 causes pistons 20 to reciprocate between its advanced and retracted positions, which in turn causes piston shoes 34 to engage drive plate 12. The axial loads caused by pistons 20 pushing on drive plate 12 are balanced by thrust pads 42. High pressure hydraulic fluid pressurized by the reciprocation of each piston 20 can pass through the respective outlet check valve 26 into ring shaped collector cavity 28 and hence to the pump output (not shown) via high pressure outlet passage 29.

Figure 3:
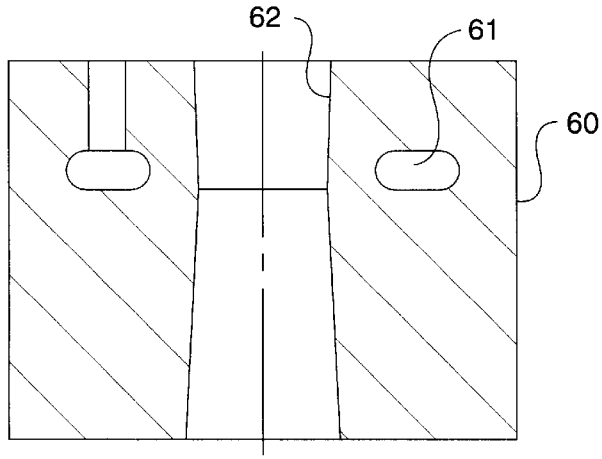
FIG. 3 is a sectioned side diagrammatic view of an unfinished pump barrel casting according to an alternative strategy.
Figure 4:
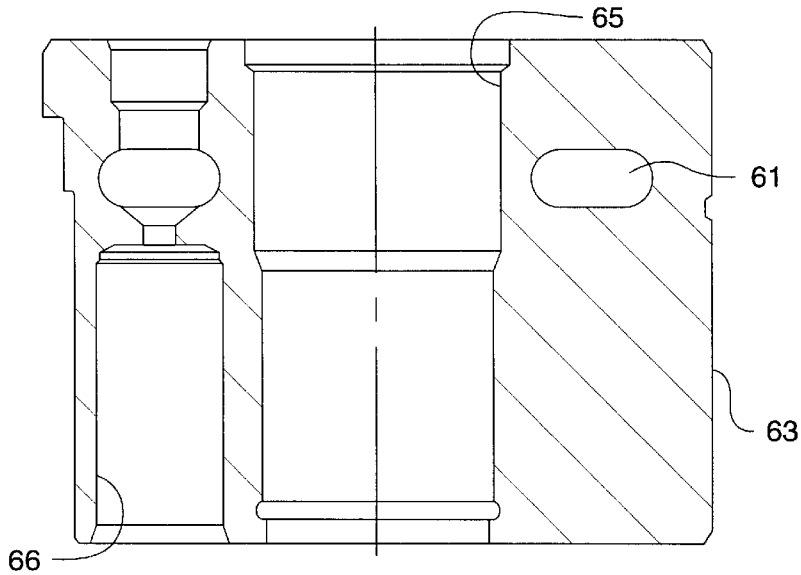
FIG. 4 is a sectioned side view of the finished pump barrel casting of FIG. 3.

Referring in addition to FIGS. 3 and 4, the two piece barrel 19 of the present invention can be compared to a finished barrel 63 of the casted alternative, which is machined from a casting 60. Prior to finishing, casting 60 defines a ring shaped accumulator cavity 61 and an unfinished central shaft bore 62. During finishing, a plurality of parallel piston bores 66 are machined into barrel 63 and central shaft bore 62 is detailed to create finished shaft bore 65. Because no plug is utilized by the casted barrel 63 to separate shaft bore 65 and ring shaped cavity 63, imprecise casting of ring shaped accumulator cavity 61 could result in a variable thickness of barrel 63 separating shaft bore 65 and ring shaped cavity 62. Thus it should be appreciated that tolerances of barrel 63 could be exceeded by normal operation of pump 1. However, instead of using sand casting or other casting methods to form ring shaped collector cavity 28, the present invention utilizes a two piece barrel 19. During manufacture, ring shaped collector cavity 28 is cut into barrel 18. After ring shaped collector cavity 28 is formed, sealing collar 10 is press fit into central shaft bore 13 at high pressure. Sealing collar 10 acts as a plug that seals off ring shaped collector cavity 28 from central shaft bore 13. Ring shaped collector cavity 28 is therefore open only to hollow interiors 21 of pistons 20 via the one or more high pressure outlet passages 29 past outlet check nozzles 26. In addition, because barrel 19 and sealing collar 10 are preferably composed of the same, or similar, material, both will experience the same, or similar, thermal expansion during optional heat treatment and/or pump operation of barrel assembly 18. Thus, sealing collar 10 acts as a plug that seals off ring shaped collector cavity 28 except for outlet check nozzles 26 and the one or more high pressure outlet passages 29, such that adequate sealing between central bore 13 and ring shaped collector cavity 28 can be achieved.

The above description is intended for illustrative purposes only, and is not intended to limit the scope of the present invention in any way. For instance, it should be appreciated that other suitable methods of finishing the barrel assembly of the present invention could be utilized. One such method would be a shrink heat fitting method where the barrel was heated sufficiently to expand, and the collar was then inserted into the central shaft while it was expanded. Thus, those skilled in the art will appreciate that other aspects, objects and advantages of this invention can be obtained from a study of the drawings, the disclosure and the appended claims which is recited in the claims set forth below.

What is claimed is:

1. A barrel assembly for an axial piston pump comprising:

a barrel defining a ring shaped cavity opening to a central bore, and a plurality of parallel piston bores surrounding said central bore and opening to said ring shaped cavity; and a collar attached to said barrel via an interaction between said barrel and an outer surface of said collar, and closing said ring shaped cavity to said central bore.

2. The barrel assembly of claim 1 wherein said barrel and said collar are made of materials having substantially similar coefficients of thermal expansion.

3. The barrel assembly of claim 2 wherein said barrel and said collar are made of identical materials.

4. The barrel assembly of claim 3 wherein said identical materials are a substantially homogenous metallic alloy.

5. The barrel assembly of claim 1 wherein said collar is ring shaped with a substantially uniform thickness.

6. The barrel assembly of claim 1 wherein said collar is press fit attached to said barrel; and said barrel and said collar are made of materials with substantially similar coefficients of thermal expansion.

7. A barrel assembly for an axial piston pump comprising:

a barrel defining a ring shaped cavity opening to a central bore, and a plurality of parallel piston bores surrounding said central bore and opening to said ring shaped cavity;

a collar attached to said barrel and closing said ring shaped cavity to said central bore; and said collar has an outside diameter greater than an inside diameter of said central bore.

8. The barrel assembly of claim 7 wherein said collar is press fit attached to said barrel.

9. A pump comprising:

a housing;

a barrel assembly mounted in said housing, and including a collar attached to a barrel via an interaction between said barrel and an outer surface of said collar, to define a ring shaped cavity surrounding and closed to a central bore, and said barrel defining a plurality of parallel piston bores that open to said ring shaped cavity;

a piston slideably received in each of said piston bores;

a drive plate having a slanted drive surface rotatably mounted in said housing and being operably coupled to each said piston.

10. The pump of claim 9 wherein said collar has an outside diameter greater than an inside diameter of said central bore.

11. The pump of claim 10 wherein said collar is press fit attached to said barrel.

12. The pump of claim 9 wherein said barrel and said collar are made of materials having substantially similar coefficients of thermal expansion.

13. The pump of claim 12 wherein said barrel and said collar are made of identical materials.

14. The pump of claim 13 wherein said identical materials are a substantially homogenous metallic alloy.

15. The pump of claim 9 wherein said collar is ring shaped with a substantially uniform thickness.

16. The pump of claim 9 wherein said collar is press fit attached to said barrel; and said barrel and said collar are made of identical materials.

17. A method of making a barrel assembly for a pump comprising the steps of:

forming a barrel to include a ring shaped cavity that opens to a central bore; and closing said ring shaped cavity to said central bore at least in part by attaching a plug to said barrel via an interaction between said barrel and an outer surface of said plug.

18. The method of claim 17 including a step of choosing a barrel material and a plug material that have substantially equal coefficients of thermal expansion.

19. The method of claim 18 wherein forming step includes a step of machining said barrel from a block of substantially homogenous metal; and machining said plug from a block of said substantially homogenous material.

20. The method of claim 19 wherein said step of machining said plug includes a step of forming said plug into a collar that defines a shaft bore; and said attaching step includes a step of press fitting said collar into said central bore.

* * * * *